United States Patent [19]

Traller et al.

[11] Patent Number: 5,014,527

[45] Date of Patent: May 14, 1991

[54] KICKPROOFER

[76] Inventors: Thomas H. Traller, 5200 Meadow Creek #2172; Helene S. Lande, 15828 El Estado, both of Dallas, Tex. 75248

[21] Appl. No.: 434,016

[22] Filed: Nov. 8, 1989

[51] Int. Cl.[5] ..... E05B 65/00

[52] U.S. Cl. ..... 70/94; 292/259 R; 292/338

[58] Field of Search ..... 70/94; 292/259, 338, 292/339

[56] References Cited

U.S. PATENT DOCUMENTS

| | | | |
|---|---|---|---|
| 3,608,940 | 9/1971 | Mueller | 292/338 X |
| 3,980,328 | 9/1976 | Pearson | 292/259 X |
| 4,078,836 | 3/1978 | Wilson | 292/338 X |
| 4,330,147 | 5/1982 | Nolen | 292/259 |
| 4,413,852 | 11/1983 | Burnell et al. | 292/259 |
| 4,429,911 | 2/1984 | O'Neal et al. | 292/259 |
| 4,548,436 | 10/1985 | Cole, Jr. | 292/259 X |
| 4,562,708 | 1/1986 | Gros | 70/94 |
| 4,762,350 | 8/1988 | Hurtado | 292/259 |
| 4,772,053 | 9/1988 | Oxley | 292/259 |
| 4,796,445 | 1/1989 | Norden, Jr. | 70/94 |

FOREIGN PATENT DOCUMENTS

| | | | |
|---|---|---|---|
| 985338 | 3/1976 | Canada | 292/259 |
| 3605435 | 8/1987 | Fed. Rep. of Germany | 292/339 |

*Primary Examiner*—Gary L. Smith
*Assistant Examiner*—Suzanne L. Dino
*Attorney, Agent, or Firm*—John E. Vandigriff

[57] ABSTRACT

A security device to protect a door from forced entry consisting of two brackets, a rigid form and one or more male protrusions. The brackets are securely attached to both sides of a door jamb and secured adjacent and perpendicular to the center line of the keyed lock of the door. The form slides into the brackets, buttressed in place with the male protrusions when the door is closed. An optional embodiment utilizes a plate placed over and blocking access to the locking device of the door.

15 Claims, 3 Drawing Sheets

KICKPROOFER

BACKGROUND OF THE INVENTION

1. Field of the Invention

This invention relates to security devices, specifically an appliance that attaches to the frame of a door, fitting over the door's locking devices and protecting the door to prevent forced entry.

2. Description of Prior Art

The alarming increase of crime, violence and murder in recent years has brought about a greater need for security devices. The traditional methods of preventing forced entry, the use of locks and dead bolts, has not fulfilled society's needs. An average adult male or muscular female, intent on gaining forced entry, can generally kick in a door, no matter how many lock and dead bolts have been installed.

Electronic surveillance systems have proved inadequate. The savy hit-and-run criminal often escapes before the police arrive. He is frequently knowledgeable about response times.

Traditional gates, commonly swinging on hinges, are often expensive and not appropriate for today's buildings. Many high density structures forbid them.

Therefore, there is a need for a device that will secure doors from forced entry. This is particularly applicable in areas of high density sturctures in which the entry door is the only method of entrance.

The Kickproofer prevents forced entry by protecting the locks and dead bolts of a door from forced entry.

Consequently, with the ever-increasing escalation of crime, the need to protect doors from forced entry becomes more and more critical.

OBJECTS AND ADVANTAGES

Accordingly, several objects and advantages include the security protection afforded by the Kickproofer, designed to satisfy the aforementioned needs.

(a) A commonly utilized method of achieving forced entry involves kicking in a door, specifically by kicking in the locking device of the door. The impact of the kick on the lock generally breaks the lock, door or door jamb, or combination of the aformentioned. The impact of a kick on any other section of the door is generally unsuccessful. Therefore, the Kickproofer is an excellent apparatus for preventing forced entry.

(b) The Kickproofer utilizes the mortised form of the door jamb and the understructure of the door frame to distribute the impact.

(c) The Kickproofer is lightweight and easy to put in place once the brackets are installed.

(d) The Kickproofer is particularly useful in high density structures in which an entry door is the only method of entrance.

(e) The Kickproofer is a relatively inexpensive security apparatus.

(f) In the event of fire or other danger, a person can escape through a door secured by the Kickproofer, even if it is in place, by going under the apparatus.

(g) The Kickproofer can be used on a door having a left or right entry.

(h) The Kickproofor can be decorative and manufactured in a wide variety of colors.

(i) The Kickproofer can be installed in areas where gates are prohibited.

(j) The Kickproofer can be easily removed and stored.

(k) The Kickproofer can be utilized to prevent entry by a person having a key to the locking device of a door. An optional plate can be inserted to block accessibility to the locking device.

SUMMARY OF THE INVENTION

The reader will see that the Kickproofer provides a highly reliable, yet relatively economical, security device to prevent forced entry, thus securing person and property in today's world of ever escalating crime.

The brackets of the Kickproofer are securely attached to both sides of the door jamb, adjacent and perpendicular to the center line of the keyed door lock. A plate slides into the brackets, buttressed in places with at least one male protrusion when the door is closed, thus protecting the door from kick-ins by a potential intruder.

The average adult male or muscular female, intent on breaking in, can generally kick in a door by kicking in the door's locks. Kicking in the door in any other location will generally not disloadge it. This is a common method of achieving forced entry. The impact of the kick on the lock generally breaks the lock, door or door jamb, or a combination of all.

The Kickproofer can be constructed of metal, plastic or wood products, or a combination of the aformentioned, in a wide variety of colors. An optional embodiment blocks the locking device of the door, affording additional protection. It utilizes a plate placed over and blocking access to the locking device of the door.

There are numerous possibilities with regard to the relative dispostion of decorative designs. These can be patterned in any fashion that preserves the basic integrity of the product.

DETAILED DESCRIPTION OF THE DRAWINGS

Referring to the figures of the drawings, and particularly FIGS. 1–4, plate 9 (FIG. 1) is one part of the invention denoted as the "Kickproofer" security apparatus for doors. Plate 9 may be formed, for example, of a continuous length of a rigid material such as welded or bolted steel shapes, extruded or cast aluminum, or other metal or combination of metals, or rigid formed, extruded or molded plastic or wood products. Plate 9 has holes 6 and 7 extending through the plate for securing the plate in place as described below. Plate 9 has at least one opening *9a* to allow access to a door lock and/or dead bolt lock on a door.

Channel brackets 10 are another part of the invention, and are used for holding "Kickproofer" plate 9 in place. Brackets 10 may be formed, for example, of a continuous length of the same material from which plate 9 is constructed. Brackets 10 have openings 6*a*, 7*a* and 8 extend through flanged 10*a* and 10*b* which extend from the sides of the brackets. Opening 6*a* do not extend complete through the flange 10*a*. Flanges 10*a* and 10*b* form a channel 15 in which plate 9 is place, as described below.

Figure 2:
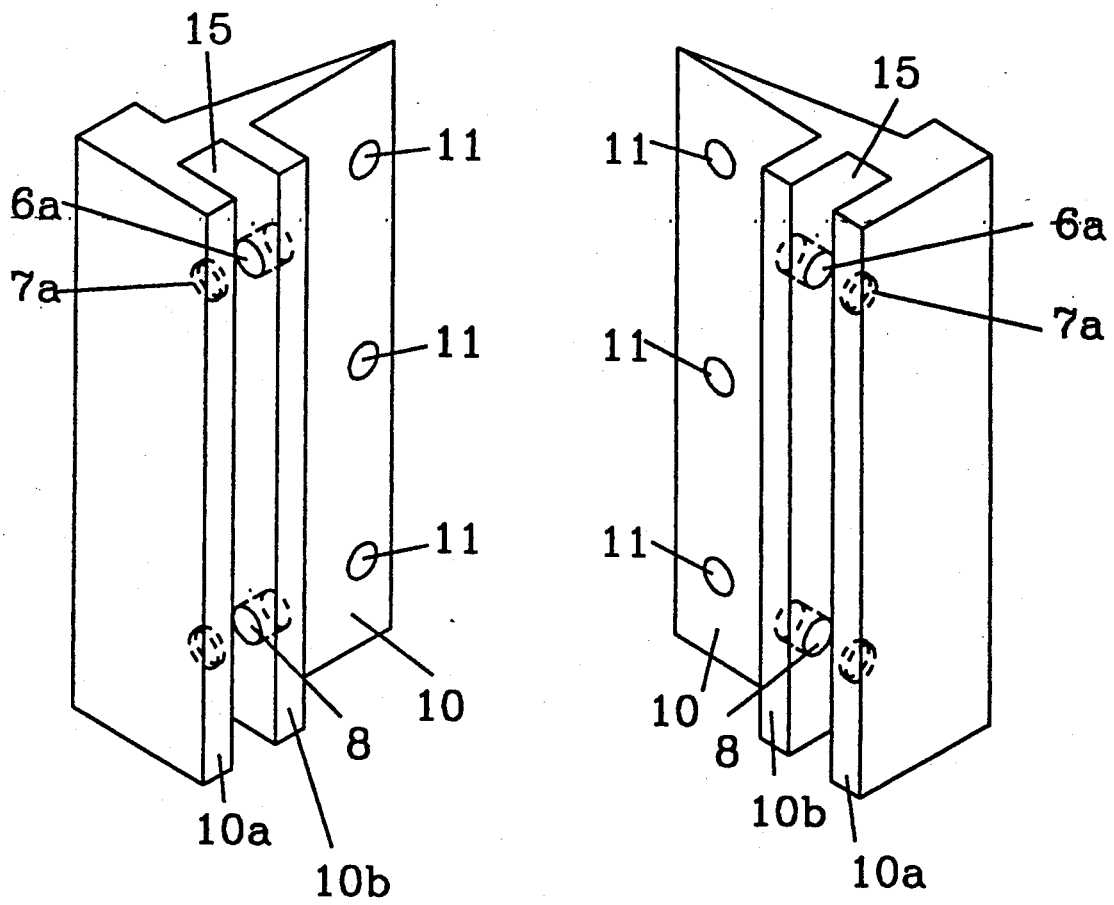
FIG. 2 depicts schematic view of a second embodiment of the Kickproofer security apparatus for doors.
Figure 1:
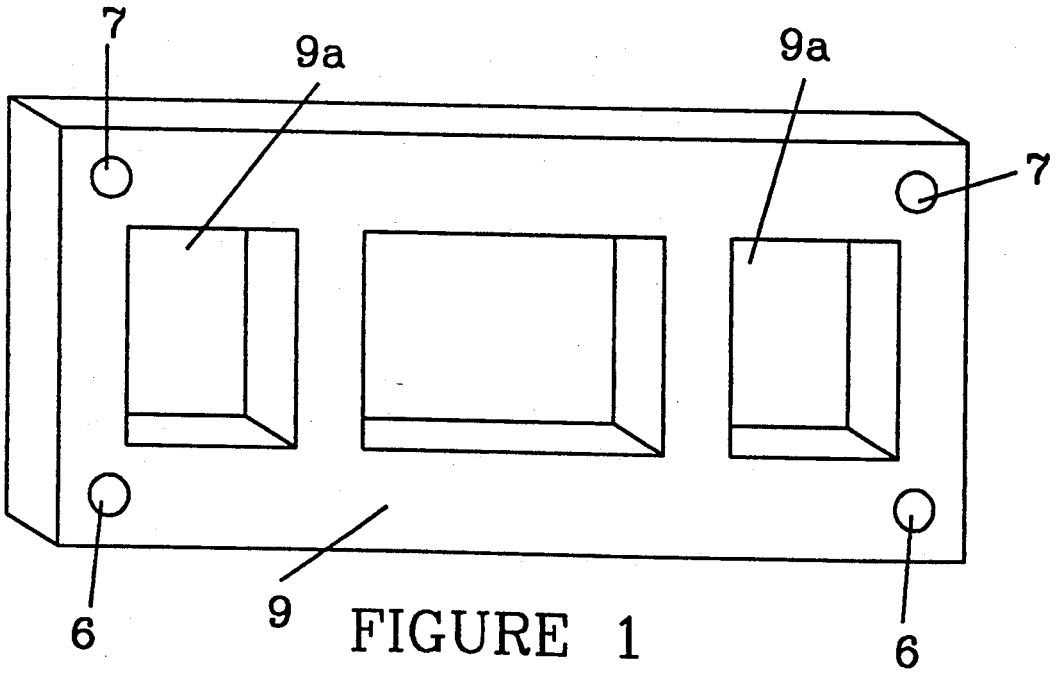
FIG. 1 depicts a plan view of a first embodiment of the kickproofer security apparatus for doors.
Figure 3:
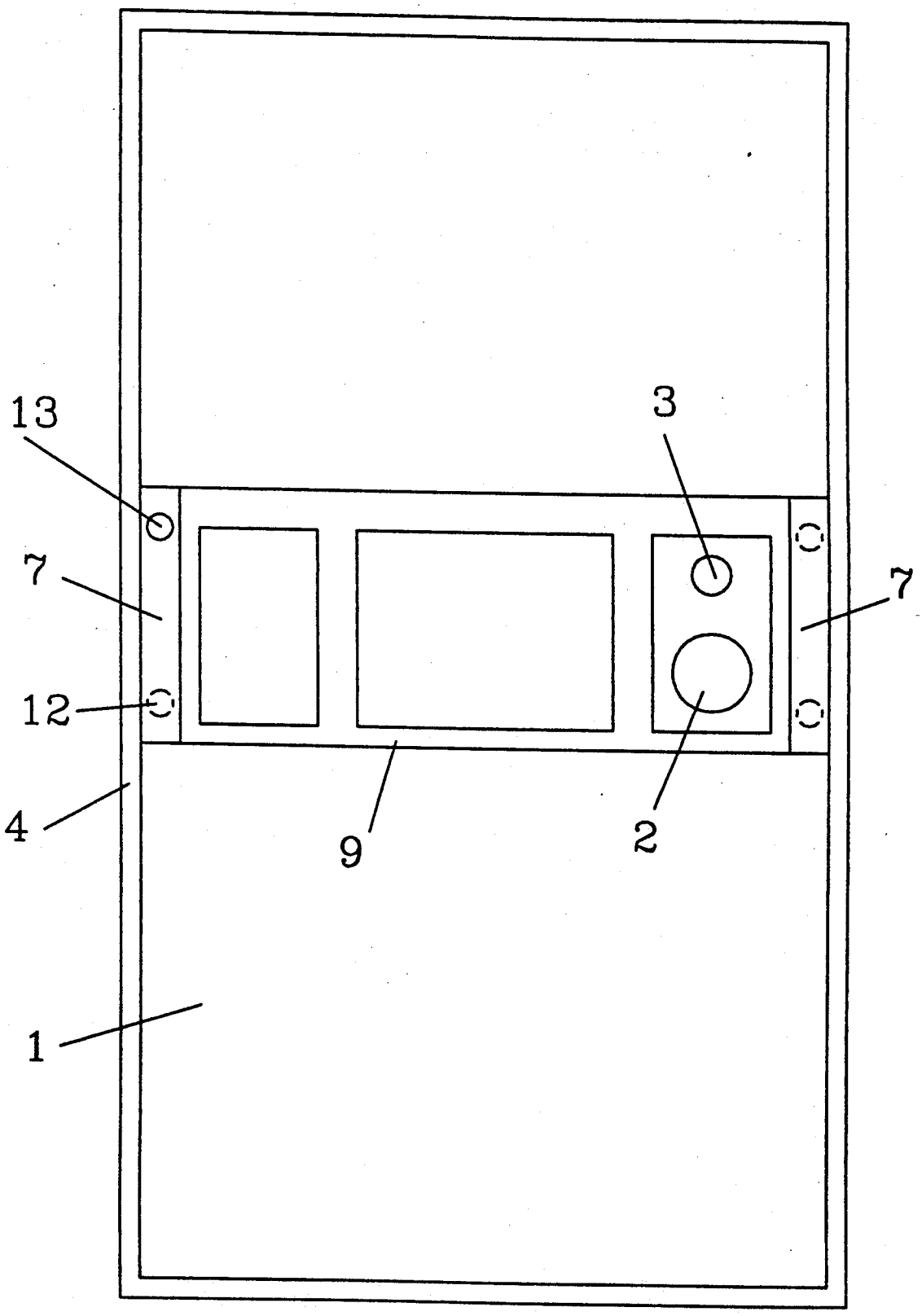
FIG. 3 depicts a plan view of FIG. 1 inserted into FIG. 2 and is in the proper location on an entrance door.

FIG. 3 illustrates a door 1 with plate 9 and channel brackets 10 in position to protect keyed lock 2 and dead bolt 3. Plate 9 is in channel 15 of brackets 10 and held there by pins in openings 6*a*, and 7*a* and 8, as described below.

Figure 4:
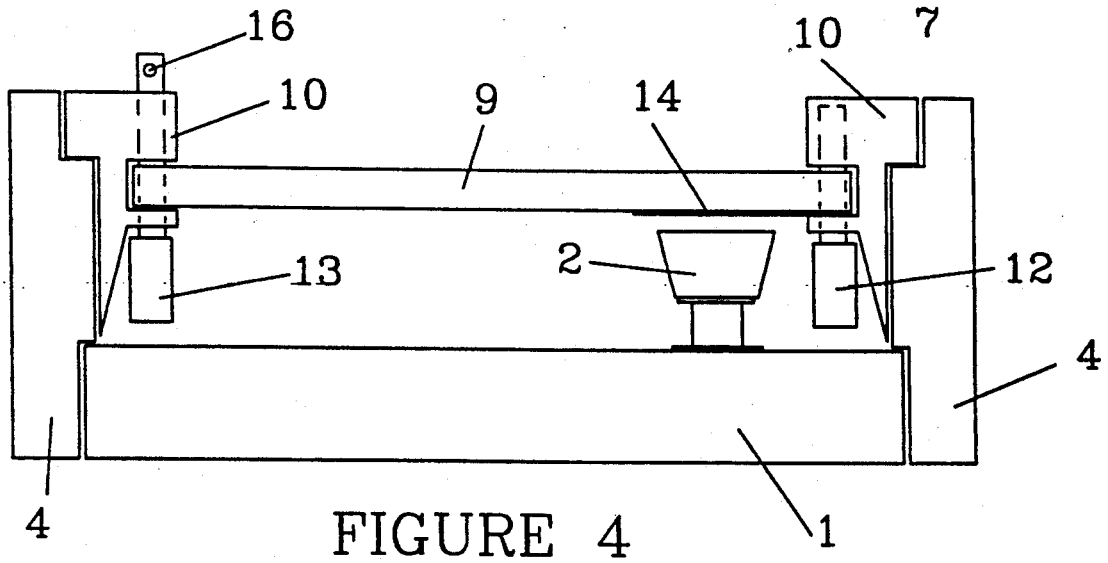
FIG. 4 depicts a top view of FIG. 3.

FIG. 4 illustrates a top view of a door 1 and "Kickproofer" security apparatus of FIG. 3. Brackets 10 are attached to door jambs 4 with flat head wood screws 11 (FIG. 2) and plate 9 is in position in channels 15 in brackets 10. FIG. 4 also shows male protrusions security pins 12, in place, extending through plate 9 and into openings 6*a* and 7*a* in channel brackets 10. A second extended length security pin, pin 13, penetrates through at least one opening 8 in brackets 10.

Figure 5:
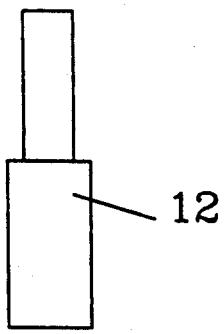
FIG. 5 depicts a plan view of a male protrustion which is placed through FIG. 1 and FIG. 2.

FIG. 5 illustrates security pin 12 which is placed through plate 9 and opening 6*a* and 7*a* in brackets 10. Opening 7*a* does not extend through flange 10*a*. Pins 12 cannot be removed when in place and door 1 is closed since there is not sufficient room to slide pins back toward the door when the door is closed.

Figure 6:
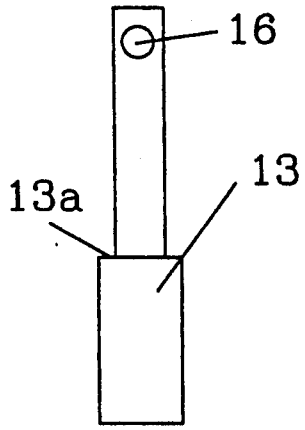
FIG. 6 depicts a plan view of a extended male protrusion which is placed through FIG. 1 and FIG. 2.

FIG. 6 illustrates extended length security pin 13. When in place, extend length security pin 13 extends completely through openings 8 (FIG. 2) and plate 9. A locking device (not illustrated) may be place through opening 16 in one end of pin 13. Pin 13 has a shoulder 13*a* which, when in place, abuts against bracket flange 10*b*, preventing it from being pulled through opening 8 in bracket 10. One or two extended securtiy pins may be used since there is an opening 8 in each bracket 10.

Figure 7:
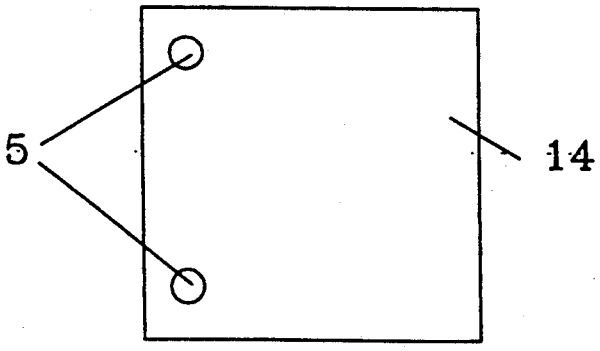
FIG. 7 depicts a plan view of a plate that covers the door's locking device.

FIG. 7 illustrates a cover plate 14 that may be used to cover the locking devices 2 and 3 on door 1 (FIG. 3). By securing plate 14 on either side of plate 9 with one pin, extended length pin 13 extending through hole 5 (in plate 14) and placing a locking device through opening 16 in pin 13, cover plate 14 will be secured in place and cannot be removed except by someone who has a key or other means to remove the locking device from hole 16 in pin 13. When in use, cover plate 14 prevents any one from tampering with key lock 2 or dead bolt 3.

Referring to FIG. 3 and 4, it may be observed that door 1 is closed against door jambs 4. Door 1 opens inwardly as does outside doors on residential houses. The "Kickproofer" security apparatus is to prevent door 1 from being "Kicked-in". To kick-in an inwardly opening door, pressure must be applied in the general region of key lock 2 and dead lock 3. The purpose of the "Kickproofer" is to cover the locking region of door 1 around locks 2 and 3, and prevent the application of sufficient pressure at the locking region, which would force door 1 open. Plate 9 covers the locking region of door 1 and absorbs pressured applied to plate 9 that would normally be applied to the locking region of door 1, if plate 9 were not in place.

It should now be apparent that the present invention provides a security apparatus that will secure a door from an intruder who would attempt to kick in the door.

Thus, while a perferred embodiment of the invention has been illustrated herein, it is to be understood that changes and variations may be made by those skilled in the art without departing from the spirit and scope of the claims.

We claim:

1. A security apparatus for securing an inwardly opening door, having locking devices centrally located at one vertical side of the door, from the side of the door adjacent the door jam, comprising:

a pair of mounting brackets mounted adjacent the vertical edges of the door on the door jams;

a rigid plate mounted in the mouting brackets separated from, the locking devices on the door; and securing pins inserted in the mounting brackets and through the rigid plate only while the door is in an open position securing the rigid plate in place;

whereby the rigid plate partially covers the region of the door adjacent to the locking devices and covers the central region of the door when the door is closed, preventing pressure from being applied to the central part of the door adjacent the locking devices.

2. The security apparatus according to claim 1, wherein the rigid plate has at least one opening therein to provide access to the locking devices when the door is closed and the security apparatus is in plate.

3. The security apparatus according to claim 2, including a cover plate for covering the at least one opening, providing access to the locking devices, to block access to the locking devices.

4. The security apparatus according to claim 3, wherein the cover plate is held in position by at least one securing pin that has a locking mechanism on the securing pin.

5. The security apparatus according to claim 1, wherein the securing pins are inserted in the brackets and through the rigid plated from the door side of the mounting brackets and rigid plate.

6. The security apparatus according to claim 5, wherein the securing pins can be inserted or withdrawn from the mounting brackets and rigid plate only when the door is in an open position.

7. The security device according to claim 1, wherein the mounting brackets have vertically extending channels therein such that the rigid plate is positioned in the brackets by sliding the rigid plate vertically downward into the bracket channels.

8. The security apparatus according to claim 1, wherein there are at least two securing pins holding the rigid plate in the brackets.

9. The security apparatus according to claim 1, including an opening in the rigid plate adjacent the locking devices, and a cover plate for covering the opening preventing access to the locking devices when the door is closed, whereby the cover plate is held in position by said securing pins.

10. The security apparatus according to claim 9, including a locking mechanism on one of the securing pins so that the convering plate may be locked into position or removed when the door is in a closed position.

11. A security apparatus for securing an inwardly opening door from the outside face of the door such that the door can be opened from either side by the securing person, having locking devices centrally located at one vertical side of the door, from the side of the door adjacent the door jam, comprising:

a pair of mounting brackets having vertical channels therein mounted adjacent the vertical edges of the door on the door jams;

a rigid plate mounted in the vertical channels of the mounting brackets and partially covering the locking devices on the door; and securing pins inserted in the mounting brackets and through the rigid plate only when the door is in an open position securing the rigid plate in place;

whereby the rigid plate partially covers the region of the door adjacent to the locking devices and cover the central region of the door when the door is closed, preventing pressure from being applied to the central part of the door adjacent the locking devices.

12. The securing apparatus according to claim 11, wherein the apparatus is made from at least one material selected from the group comprising metal, plastic and wood products.

13. A method of securing an inwardly opening door from the outside face of the door with locking devices using a rigid plate with openings therein, securing pins and a pair of mounting brackets, secured to the door jams such that each bracket has one side adjacent the door when closed, having vertical channels therein and openings for said securing pins, comprising the steps of:

positioning the door in an inwardly open position;

sliding the rigid plate into the vertical channels in the mounting brackets, placing securing pins through some of the openings in the mounting brackets and through some of the openings in the rigid plated from the side of the mounting brackets adjacent the door only when the door is in an open position to secure the rigid plated in the mounting brackets; and closing the door to prevent the securing pins from being removed from the brackets and rigid plate when the door is closed.

14. The method according to claim 13, including the step of placing a cover plate over one of the openings in the rigid plate to block access to the locking devices on the door.

15. The method according to claim 14, including the step of securing the cover plate with a securing pin having a locking mechanism thereon.

* * * * *